US005966107A

United States Patent [19]

Amemiya

[11] Patent Number: 5,966,107

[45] Date of Patent: Oct. 12, 1999

[54] METHOD FOR DRIVING A PLASMA DISPLAY PANEL

[75] Inventor: Kimio Amemiya, Koufu, Japan

[73] Assignee: Pioneer Electronic Corporation, Tokyo, Japan

[21] Appl. No.: 08/901,883

[22] Filed: Jul. 29, 1997

[30] Foreign Application Priority Data

Sep. 3, 1996 [JP] Japan ..... 8-252286

[51] Int. Cl.[6] ..... G09G 3/28

[52] U.S. Cl. ..... 345/60; 315/169.4

[58] Field of Search ..... 345/60, 66, 63, 345/67, 68, 208, 209, 79; 315/169.4, 169.1

[56] References Cited

U.S. PATENT DOCUMENTS 5,446,344 8/1995 Kanazawa ..... 315/169.4

5,790,092 8/1998 Moriyama ..... 345/96

*Primary Examiner*—Richard A. Hjerpe
*Assistant Examiner*—Francis Nguyen
*Attorney, Agent, or Firm*—Perman & Green, LLP

[57] ABSTRACT

A driving method of a plasma display panel which has a plurality of row electrode pairs and a plurality of column electrode pairs arranged so as to intersect the row electrode pairs and form pixels at the respective intersecting sections, and which performs a display by using an address period in which a scanning pulse is applied to one of the pair of row electrodes and a pixel data pulse is applied to the column electrodes and a light-on/light-off pixel is selected in accordance with pixel data and a maintaining discharge period in which discharge maintaining pulses are alternately applied to the row electrode pair and the light-on/light-off pixel is maintained, wherein an electric potential of the column electrode is changed every pixel or every pixel group consisting of a plurality of pixels in the maintaining discharge period.

4 Claims, 3 Drawing Sheets

METHOD FOR DRIVING A PLASMA DISPLAY PANEL

BACKGROUND OF THE INVENTION

1. Field of the Invention

The invention relates to a method for driving a plasma display panel (PDP) of a surface discharge type of a matrix display system.

2. Related Background Art

In recent years, a practical use of a plasma display panel (PDP) is expected as a color display device of a large size and a thin type.

In the PDP, as is well known, electrode groups which mutually intersect are provided on the inside of a pair of substrates arranged so as to face each other through a discharge space and discharge cells are constructed at intersecting portions of the electrodes, and are selectively allowed to emit the light.

In a surface discharge type AC-PDP, for example, a plurality of maintaining electrode groups extending mutually in parallel are formed on the inner surface of the substrate on the display surface side and a dielectric layer and an MgO (magnesium oxide) layer are sequentially formed on the maintaining electrodes. Address electrodes are formed in parallel on the substrate on the back side so as to intersect the maintaining electrode pairs, a fluorescent material is formed on the address electrodes, and ribs are formed between the address electrodes. A mixture rare gas is filled in the discharge space.

The PDP operation is performed in a manner such that, for example, a predetermined voltage is first applied across the pair of maintaining electrodes, a discharge is started, a selection erasing pulse is subsequently applied to the address electrodes corresponding to discharge cells that are unnecessary for display, and wall charges in the dielectric layer are erased, thereby stopping the discharge.

Subsequently, a maintaining pulse lower than a discharge start voltage is applied to the maintaining electrode pair and the discharge is maintained with respect to the discharge cell corresponding to a display pixel. The fluorescent layer is excited by ultraviolet rays generated by the above operation and emits light. The MgO layer has functions for raising a secondary electron emission ratio and decreasing the discharge start voltage. By properly selecting a period of the maintaining pulse to maintain the discharge, a luminance of the display is adjusted.

In the surface discharge type AC-PDP, a scanning line is constructed by a set of (two) electrode lines and an alternating voltage is applied between the electrode lines, thereby forming a discharge. In this instance, the voltage is applied across the adjacent scanning lines so that polarities of the closest electrode lines are opposite because of a selectivity of the pixel.

In the AC-PDP of the surface discharge type, since transparent electrodes are used as maintaining electrodes, a resistivity is large. Hitherto, therefore, bus electrodes made of metal electrodes are further laminated in order to compensate a conductivity of the maintaining electrodes, thereby reducing a wiring resistance.

When the PDP is increases in size, however, since a wiring length of the metal electrode is long, the wiring resistance of the bus electrode itself cannot be also ignored.

In order to reduce the wiring resistance, it is considered that a width of the metal electrode is widened or a film thickness thereof is thickened. In the former case, since a ratio of shutting off the light emission in a unit light emitting region (discharge cell) increases, the luminance decreases. As the discharge cell size further decreases, its influence is conspicuous. In the latter case, since a film forming time becomes long, processing costs increase and, further, there is a limitation when the film is thickened by forming the film by an evaporation deposition.

In the AC-PDP, a current flowing in each discharge cell is not constant with respect to the time and is maximum in, for example, about hundreds of nanoseconds after the voltage pulse has been applied. After that, the current hardly flows in about hundreds of nanoseconds. In the maintaining discharge for the display (sustain discharge), since a pulse interval is equal to about a few microseconds, all of the discharge cells on one maintaining electrode pair (sustain line) are almost simultaneously discharged and currents almost simultaneously flow in all of the discharge cells.

The maximum value of the current of one maintaining electrode pair, therefore, is equal to a value added with the maximum value of the current flowing in each cell. A large current instantaneously flows in one maintaining electrode pair. The large instantaneous current causes a large voltage drop by a wiring resistance of the maintaining electrode, thereby deteriorating display characteristics.

As mentioned above, as a peak value of the discharge current is large, loads of a driving circuit and a power source of the AC-PDP increase and it is difficult to realize the large size of the PDP.

SUMMARY OF THE INVENTION

It is an object of the present invention to provide a method for driving a plasma display panel which can reduce a peak value of a discharge current.

According to the invention, there is provided a driving method of a plasma display panel which has a plurality of row electrode pairs and a plurality of column electrode pairs arranged so as to intersect the row electrode pairs and form pixels at respective sections intersecting the row electrode pairs, and which performs a display by using an address period in which a scanning pulse is applied to one of the pair of row electrodes and a pixel data pulse is applied to the column electrodes and a light-on/light-off pixel is selected in accordance with pixel data and a maintaining discharge period in which discharge maintaining pulses are alternately applied to the row electrode pair and the light-on/light-off pixel is maintained, wherein an electric potential of said column electrode is changed every pixel or every pixel group consisting of a plurality of pixels in the maintaining discharge period.

Since the invention is constructed as mentioned above, all of the timings when the currents flowing in the cells in one maintaining electrode pair (sustain line) become maximum don't coincide but are distributed, so that the maximum value of the current flowing in one maintaining electrode pair can be reduced.

DETAILED DESCRIPTION OF THE PREFERRED EMBODIMENTS

Preferred embodiments of the invention will now be described hereinbelow.

Figure 1:
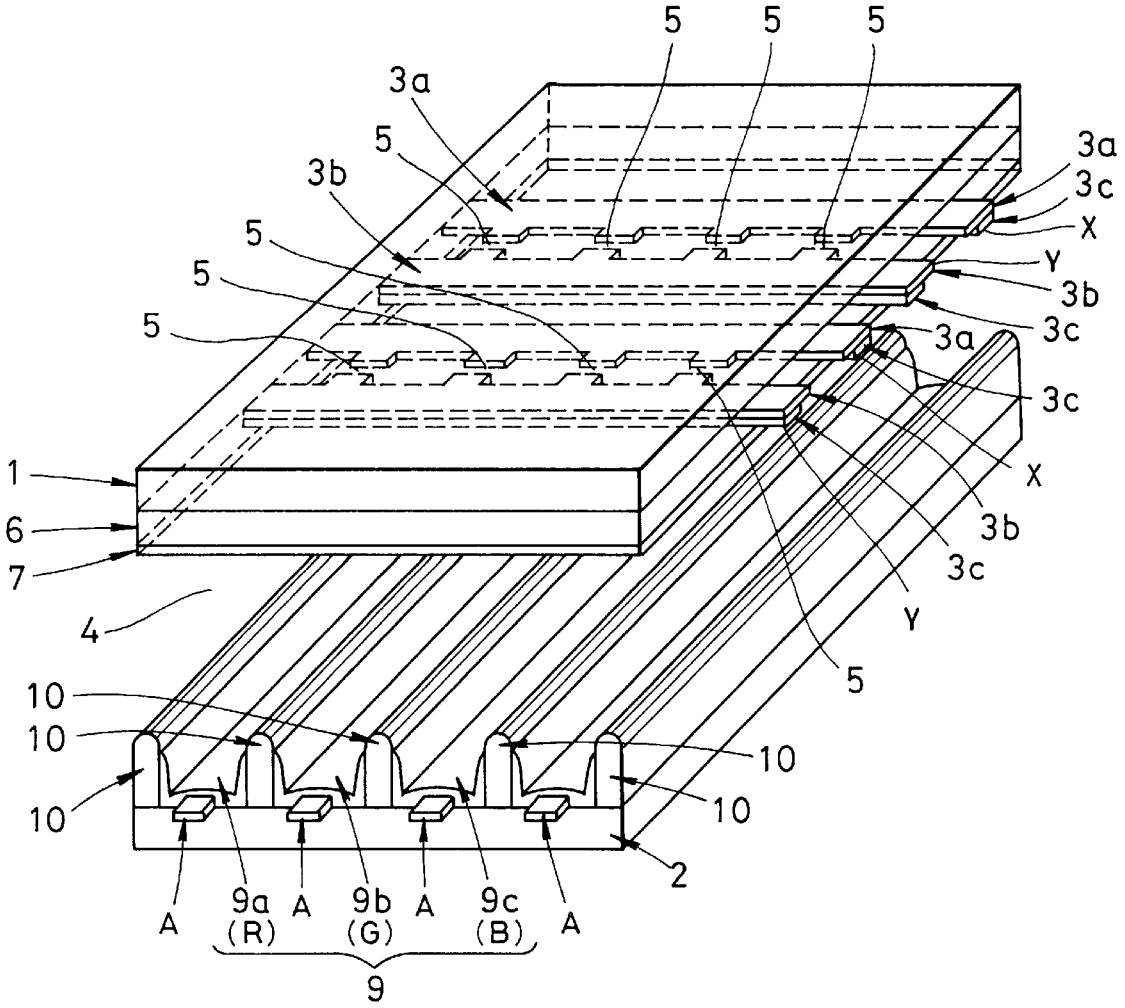
FIG. 1 is a diagram showing a schematic structure of a surface discharge type AC-PDP which is driven by a driving method according to an embodiment of the invention.

FIG. 1 is a diagram showing a schematic structure of a surface discharge type AC-PDP which is driven by a driving method according to the present invention.

As shown in FIG. 1, in the PDP, a pair of front glass substrate 1 and a back glass substrate 2 are arranged so as to face each other through a discharge space 4. A plurality of maintaining electrode pairs (row electrode pairs) X and Y each of which is constructed by longitudinal transparent electrodes 3*a* and 3*b* which are made of transparent conductive films and are arranged in parallel and a bus electrode 3*c* made of a metal film for compensating a conductivity of the transparent conductive film are mutually arranged in parallel on the inner surface of the front glass substrate 1 (surface which faces the back glass substrate 2) serving as a display surface, thereby forming each scanning line of the PDP.

Each maintaining electrode pair X, Y is constructed so that a plurality of discharge gaps 5 each serving as a center of each light emitting region are formed between the electrodes 3*a* and 3*b*. Since an electric resistance of the transparent electrode is relatively high, the bus electrode 3*c* is formed along the longitudinal direction.

The bus electrode 3*c* is formed on each of the transparent electrodes 3*a* and 3*b*, has an area smaller than each area of the transparent electrodes 3*a* and 3*b*, and is provided on the edge portion on the opposite side of the discharge gaps 5 of the maintaining electrode pair X, Y. A dielectric layer 6 made of a low melting point glass is formed on the inner surface side of the bus electrode 3*c* and, further, an MgO layer 7 is formed on the dielectric layer 6. The surface of the MgO layer 7 on the side opposite to the dielectric layer 6 side faces the discharge space 4.

A plurality of address electrodes (column electrodes) A which stereoscopically intersect the plurality of maintaining electrode pairs X and Y and are arranged at predetermined intervals from the plurality of maintaining electrode pairs X and Y through the discharge space 4 are mutually formed in parallel on the inner surface side of the back glass substrate 2 on the opposite side. Fluorescent layers 9 are formed so as to cover the address electrodes A. As a fluorescent layer 9, one set of red light emitting material 9*a*, green light emitting material 9*b*, and blue light emitting material 9*c* is repetitively formed every three adjacent address electrodes A.

Partition walls (ribs) 10 each having a predetermined height are formed between the adjacent address electrodes A on the back glass substrate 2. The discharge space 4 is partitioned by the ribs 10.

The fluorescent layers 9 are formed between the partition walls (ribs) 10. The discharge space 4 is formed so as to be closed by the front glass substrate 1 on which the plurality of maintaining electrode pairs X and Y are formed and the back glass substrate 2 having the plurality of address electrodes A on which the plurality of sets of fluorescent layers 9 are formed. A discharge gas (not shown) in which, for example, xenon is mixed into neon is filled and sealed in the discharge space 4.

Pixels (discharge cells) are formed in the intersecting sections between the maintaining electrode pairs X and Y and address electrodes A.

As mentioned above, the surface discharge type AC-PDP driven by the driving method according to the present invention is constructed.

The driving operation of each portion in case of allowing each discharge cell of the surface discharge type AC-PDP to emit the light will now be described. The driving operation is performed by a drive control circuit (not shown).

In an all reset period of time, a reset pulse is first applied across each maintaining electrode pair X and Y in FIG. 1 at the same time, thereby allowing each discharge cell to discharge once and then to form a wall charge. Subsequently, in an address period of time, a scanning pulse is in turn applied to one of each of the maintaining electrode pairs X and Y and a pixel data pulse is applied to each address electrode A in synchronism with the scanning pulse, thereby erasing the wall charges which has been selectively formed in accordance with the pixel data in the all reset period of time to select light-on and light-off pixels.

Figure 2:
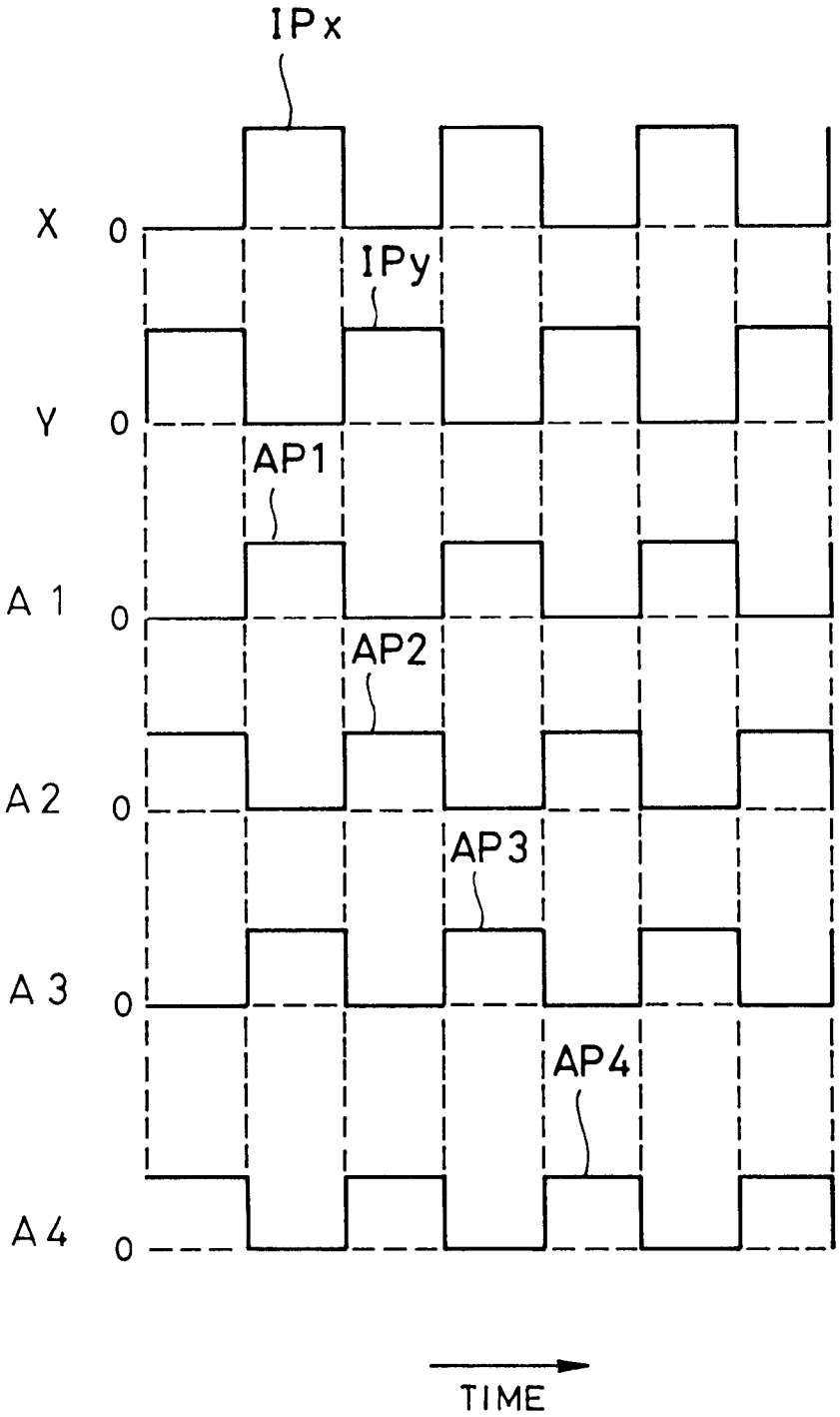
FIG. 2 is a waveform diagram showing driving pulse waveforms of each maintaining electrode pair and each address electrode of the surface discharge type AC-PDP in FIG. 1.

Next, each maintaining electrode pair X, Y is supplied with alternate maintaining pulses IPx and IPy in a maintaining discharge period of time, and then each pixel (light-on pixel) of which the wall charge has not been erased in an address period emits a discharge light, on the other hand, each pixel (light-off pixel) of which the wall charge has been erased in the address period does not emit a discharge light in spite of the supplying of the maintaining pulses. Namely, a discharge cell alone having a wall charge is supplied with a voltage higher than a discharge starting voltage since the voltage of the wall charge is added to the voltage of the maintaining pulse, thereby maintaining a light-on state. FIG. 2 is a diagram showing driving pulse waveforms of each maintaining electrode pair and each address electrode in a maintaining discharge period of time in the driving method of the plasma display panel according to the first embodiment of the invention.

In FIG. 2, pulses shown at AP1, AP2, AP3, and AP4 show the pulses which are applied in correspondence to the adjacent address electrodes A1, A2, A3, and A4 which are sequentially arranged (in the diagram, four address electrodes). The address pulses AP1 and AP3 applied across the address electrodes A1 and A3 have the same polarity as the maintaining pulse IPx applied across the electrodes X of the maintaining electrode pairs X and Y and are respectively applied in synchronism with the maintaining pulse IPx. The address pulses AP2 and AP4 applied across the address electrodes A2 and A4 have the same polarity as the maintaining pulse IPy applied across the electrodes Y of the maintaining electrode pairs X and Y and are respectively applied in synchronism with the maintaining pulse IPy. Namely, when the address electrodes A1 and A3 are equal to the ground potential, the address electrodes A2 and A4 have a predetermined positive potential. When the address electrodes A2 and A4 are equal to the predetermined positive potential, the address electrodes A1 and A3 have the ground potential.

At the same time in a maintaining discharge period of time, when a potential (a potential of the address electrode A1 or A3) of the address electrode (column electrode) of one discharge cell (pixel) is set to be different from a potential of the address electrode of another discharge cell next to the one discharge cell on the same display line, a peak current of the same maintaining electrode pair decreases entirely since a current flowing in the one discharge cell and a current flowing in the adjacent discharge cell are different from each other in timing when their currents become maximum.

Figure 3:
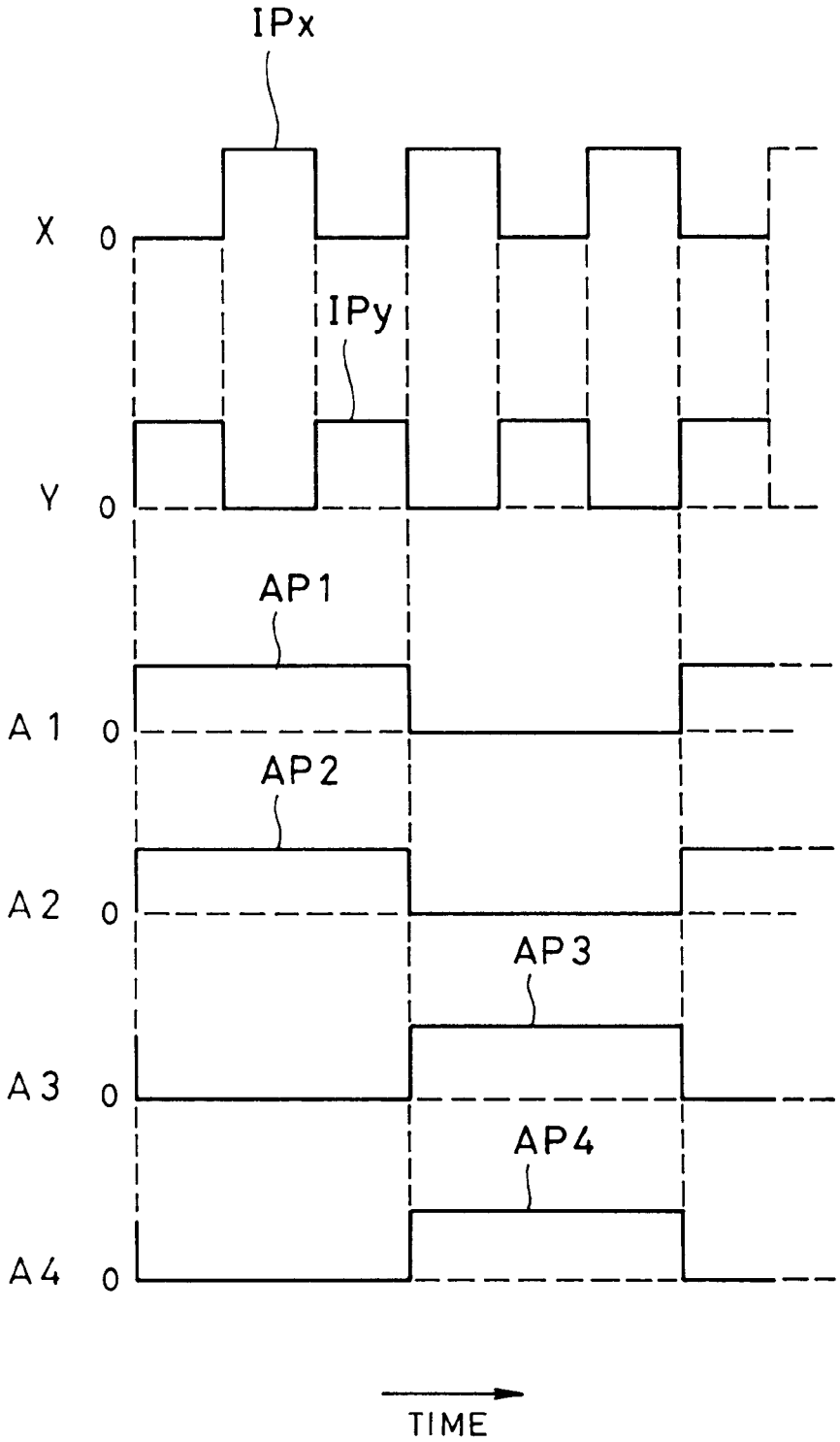
FIG. 3 is a waveform diagram showing driving pulse waveforms of each maintaining electrode pair and each address electrode of the surface discharge type AC-PDP in FIG. 1 as another embodiment of the invention.

FIG. 3 is a diagram showing driving pulse waveforms of each maintaining electrode pair and each address electrode in a maintaining discharge period of time in the driving method of the plasma display panel according to the second embodiment of the invention.

In the second embodiment, a period of the address pulse is set three times longer than that of the address pulse of the first embodiment, cells on the same display line are divided into a plurality of cell groups each of which consists of a plurality of adjacent cells, and a potential of an address electrode group (A1 and A2, A3 and A4) corresponding to each of the cell groups is set to be different every cell group. Namely, the adjacent address electrodes are used as one set, the address electrodes A3 and A4 have the ground potential when the address electrodes A1 and A2 are equal to a predetermined positive potential, and the address electrodes A3 and A4 have the predetermined positive potential when the address electrodes A1 and A2 are equal to the ground potential. Even when potentials of the address electrodes are changed, operation and effect similar to those of the first embodiment can be obtained.

Although the above first and second embodiments are constructed that all the cells on the same display line are divided into a plurality of cell groups each of which consists of a plurality of cells and a potential of an address electrode group corresponding to each of the cell groups is set to be different every cell group, a potential of each address electrode can be changed every cell (pixel).

Further, although the above first and second embodiments are constructed that an address pulse is alternately applied to the respective address electrode groups, operation and effect similar to their embodiments can be obtained if fixed potential values differing from each other are applied every address electrode group.

Although a preferred embodiment of the invention has been illustrated and described, it is readily understood by those skilled in the art that various modifications may be made therein without departing from the spirit of the invention or from the scope of the appended claims.

What is claimed is:

1. A method for driving a plasma display panel which has a plurality of row electrode pairs and a plurality of column electrodes arranged so as to intersect said row electrode pairs and form pixels at the respective sections intersecting said row electrode pairs, and which performs a display by using an address period in which a scanning pulse is applied to one of said pair of row electrodes and a pixel data pulse is applied to said column electrodes and a light-on/light-off pixel is selected in accordance with pixel data and a maintaining discharge period in which discharge maintaining pulses are alternately applied to said row electrode pair and said light-on/light-off pixel is maintained, wherein electric potentials of the respective column electrodes are different from each other every pixel or every pixel group consisting of a plurality of pixels in said maintaining discharge period.

2. A method according to claim 1, wherein said electric potentials of said respective column electrodes in said maintaining discharge period are changed in synchronism with said discharge maintaining pulses.

3. A method according to claim 1, wherein the electric potentials of the respective column electrodes of adjacent pixels or adjacent pixel groups are different from each other in the maintaining discharge period.

4. A method for driving a plasma display panel which has a plurality of row electrode pairs and a plurality of column electrodes arranged so as to intersect said row electrode pairs and form pixels at the respective sections intersecting said row electrode pairs, and which performs a display by using an address period in which a scanning pulse is applied to one of said pair of row electrodes and a pixel data pulse is applied to said column electrodes and a light-on/light-off pixel is selected in accordance with pixel data and a maintaining discharge period in which discharge maintaining pulses are alternately applied to said row electrode pair and said light-on/light-off pixel is maintained, wherein electric potentials of the respective column electrodes or respective column electrode groups each of which consists of a plurality of column electrodes are different from each other in said maintaining discharge period.

* * * * *